US006513194B2

(12) United States Patent
Harkins et al.

(10) Patent No.: US 6,513,194 B2
(45) Date of Patent: Feb. 4, 2003

(54) PIVOT CONNECTION ADJUSTMENT ASSEMBLY

(75) Inventors: Peter W. Harkins, Maroota (AU); Patrick E. Milligan, Rochester, NY (US); E. Erik Timothy, Macedon, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 09/884,984

(22) Filed: Jun. 20, 2001

(65) Prior Publication Data

US 2002/0013978 A1 Feb. 7, 2002

(30) Foreign Application Priority Data

Jun. 22, 2000 (AU) ..... PQ8322/00

(51) Int. Cl.[7] ..... E05D 7/06

(52) U.S. Cl. ..... 16/239; 16/242; 16/246; 16/248; 16/DIG. 34

(58) Field of Search ..... 16/242, 245, 246, 16/241, 239, 248, 252, 253, 366, 362, 368, 371, 374, DIG. 34; 403/100–103, 99, 93, 94; 292/263, 271–273, 277, DIG. 7, DIG. 33; 49/396, 246, 750

(56) References Cited

U.S. PATENT DOCUMENTS

| | | | | | |
|---|---|---|---|---|---|
| 3,984,191 | A | * | 10/1976 | Doty | 24/656 |
| 4,726,092 | A | * | 2/1988 | Tacheny et al. | 16/342 |
| 5,193,249 | A | * | 3/1993 | Bucher | 16/327 |
| 5,323,568 | A | * | 6/1994 | Blomqvist | 16/352 |
| RE35,635 | E | | 10/1997 | Bauman | 16/239 |
| 5,794,310 | A | | 8/1998 | Dallmann | 16/362 |
| 5,964,011 | A | * | 10/1999 | Ruston et al. | 16/239 |
| 6,112,371 | A | * | 9/2000 | Tremblay | 16/235 |

FOREIGN PATENT DOCUMENTS

WO WO 01/98612 A1 * 12/2001

* cited by examiner

*Primary Examiner*—Chuck Y. Mah
(74) *Attorney, Agent, or Firm*—Eugene Stephens & Associates

(57) ABSTRACT

An adjustment assembly enables lateral adjustment of the position of a pivot connection of a first member relative to a second member in a window assembly having a first member, a second member, and a rotatable pivot-mounting element. The pivot-mounting element includes a first pivot-mounting section with a first pivot axis operatively connected to the first member and a second pivot-mounting section operatively connected to the second member. The second pivot-mounting section has a second pivot axis that is generally parallel to and offset from the first pivot axis. An engager section is located intermediate the pivot-mounting sections. Finally, a locking member is provided to cooperate with the engager section and is movable relative to the engager section between a retention position and a release position.

16 Claims, 5 Drawing Sheets

PIVOT CONNECTION ADJUSTMENT ASSEMBLY

RELATED APPLICATIONS

This application is a Continuation-In-Part of co-pending parent Australian Provisional Patent Application No. PQ8322/00, filed Jun. 22, 2000, entitled PIVOT CONNECTION ADJUSTMENT ASSEMBLY, the disclosure of which is herein incorporated by reference.

TECHNICAL FIELD

This invention relates to an adjustment assembly which provides for adjustment of the position of the pivot connection between two parts.

BACKGROUND OF THE INVENTION

One particular application of the present invention is in relation to window assemblies having hinged stays to control movement of the window during opening and closing thereof. It will be convenient to hereinafter describe the invention with reference to this particular application. It is to be understood, however, that this is not to be taken as a limitation of the scope of the present invention. It will be apparent from a reading of the following description that the adjustment assembly could be used in other applications.

During the installation of windows into window frames, it is often necessary to be able to adjust the position of the window so that it fits properly within the window frame. Adjustable mechanisms for such windows are known. For example, adjustment mechanisms are described in U.S. Pat. Nos. RE 35635 and 5,794,310. Both of these patents describe an arrangement that includes a rivet which is inhibited from rotational movement relative to one of the hinge members by virtue of friction. Such an arrangement has the disadvantage that various parts have to be manufactured with close tolerances to ensure the frictional engagement meets the requirements of the adjustable hinge.

SUMMARY OF THE INVENTION

It is an object of the present invention to provide an improved adjustment assembly, which alleviates the aforementioned disadvantage. The improved adjustment assembly described herein can be riveted loosely if desired in order to maintain its pivot mounting element in place. However, it need not be riveted with the precision and close tolerances required by prior art designs, with consequent reductions in production cost and difficulty.

According to one aspect of the present invention, an adjustment assembly is provided for enabling lateral adjustment of the position of the pivot connection of one member relative to another member, the adjustment assembly including a pivot-mounting element including a first pivot-mounting section having a pivot axis, a second pivot-mounting section having a pivot axis, and an engager section, the pivot axes being generally parallel and offset with respect to one another. The assembly further includes a locking member adapted to cooperate with the engager section, the locking member being movable relative to the engager section between a retention position and a release position.

In an installed position, the first and second pivot-mounting sections are operatively connected to respective ones of the members for enabling relative pivotal movement therebetween. The arrangement is such that when the engagement member is in the retention position, relative rotation between one of the pivot-mounting sections and the member with which it is associated is inhibited.

When in use, the pivot-mounting element is fitted so that one member is operatively connected to the first pivot-mounting section and the other member is operatively connected to the second pivot-mounting section. With the locking member in the retention position, the second pivot mounting is inhibited from rotation relative to the member to which it is operatively connected. The member operatively connected to the first pivot-mounting member can, however, still pivot relative to the first pivot mounting. To adjust the position of the first pivot mounting relative to the member associated with the second pivot mounting, the locking member is moved into the release position, thereby permitting relative rotation between the second pivot mounting and its associated member, this rotation enabling adjustment of the position of the first pivot mounting relative to the member associated with the second pivot mounting. The locking member is then returned to its retention position.

In one form, the pivot-mounting element can include a body in which the first and second pivot-mounting sections are preferably in the form of pins, the pivot axes of the two pins being offset or eccentric with respect to one another. The engager section can be in the form of a flange or collar and in the preferred form is disposed between the pivot pins. The flange or collar can include a plurality of engager sides which are adapted to cooperate with the locking member when in the retention position to prevent rotation of the second pivot pin relative to the member with which it is associated. The engager sides can be angularly inclined with one another. This allows the engager to be rotated so that a selected engager side or sides adopt a position in which they cooperate with the locking member.

Preferably, the members with which the adjustment assembly is to be used are elongated in form. For example, they can comprise the hinge bars for a window assembly. The locking member can be adapted for sliding movement along one of the members. The sliding locking member in one preferred embodiment can include a body portion having a guide thereon. This guide is locatable within a slot on one of the members which defines a track enabling sliding movement of the body therealong. The body can further include a recess having side walls which are adapted to cooperate with the engager member to limit rotation of the second pivot pin when in the locked position. The recess preferably has a cavity thereabove, the cavity including an upper wall, which in the locked position overlies the pin to hold it in place on its associated member.

Alternatively, the locking member can be pivotally affixed to one of the members. In this circumstance, the pivoting locking member would be rotated into and out of locked position. In its locked position, it would have edges that are adapted to cooperate with the engager member to limit rotation of the second pivot pin. The pivoting locking member can be provided with means for affixing it firmly in locked position, such as a screw that can serve as its pivot and can also be tightened to secure the pivoting locking member in the locked position. This screw could also be loosened to allow the pivoting locking member to be rotated into an unlocked position. The pivoting locking member should also be provided with an upper member, which in the locked position overlies the pin to hold it in place on its associated member.

DESCRIPTION OF THE DRAWINGS

In order to enable a clearer understanding of the invention, drawings illustrating preferred embodiments are attached, and in those drawings.

DESCRIPTION OF THE INVENTION

Figure 1:
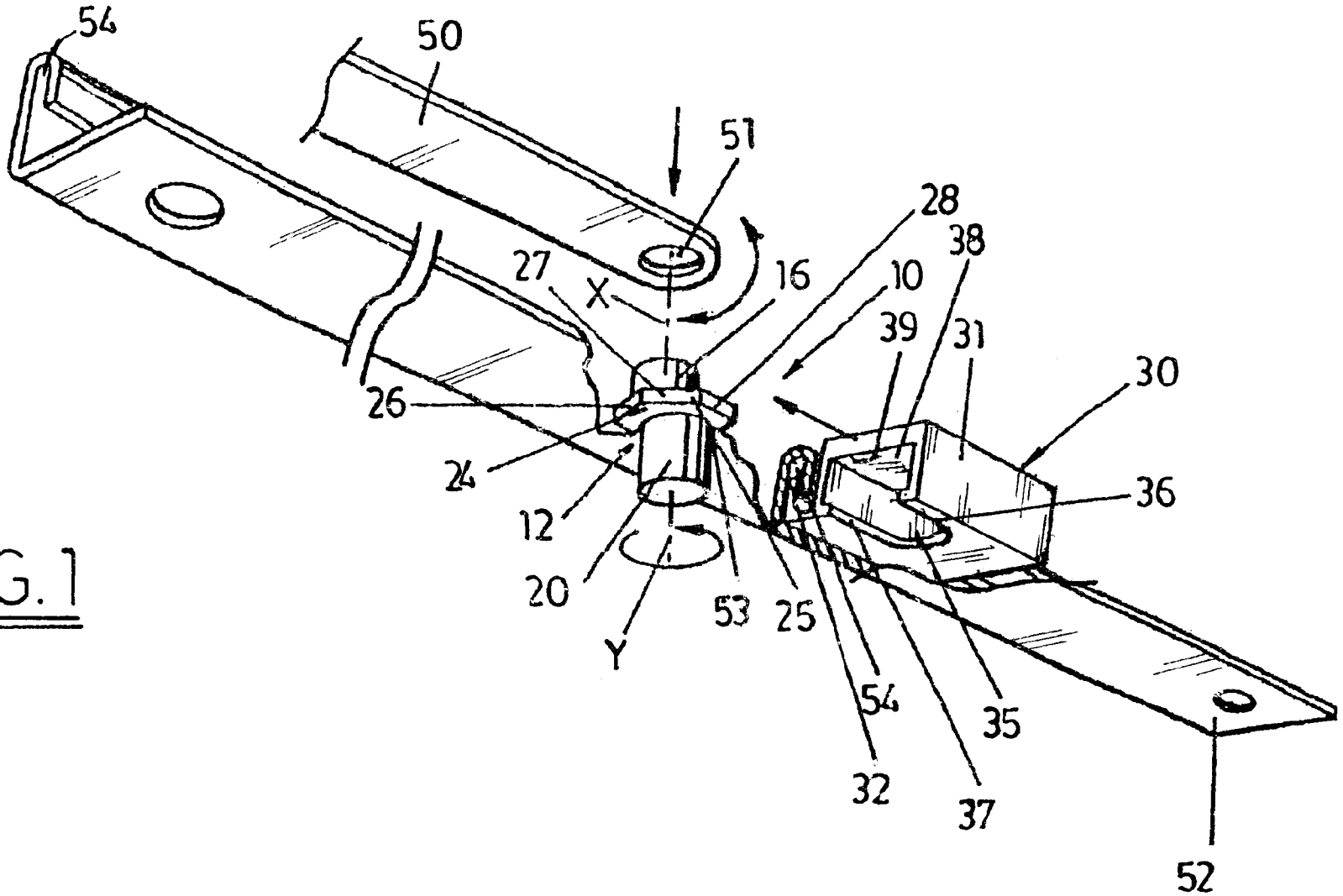
FIG. 1 is a schematic perspective view of a first embodiment of an adjustment assembly according to the present invention, shown in a release position.

Referring to the drawings for both preferred embodiments, it will be seen that the adjustment assembly generally indicated at 10 is for use in adjusting the lateral position of the pivot axis between a first member 50 and a second member 52. In the embodiments shown, the members can form part of a window opening and closing mechanism, such as, for example, the mechanism described in International Patent Application No. PCT/AU98/00982, the contents of which are incorporated into this specification by cross-reference. As shown, the member 50 is in the form of a connecting arm and the member 52 is in the form of a runner frame.

The assembly 10 includes a pivot-mounting element 12 comprising a first pivot-mounting section in the form of a pin 16 having a central pivot axis X. The pivot-mounting element 12 further includes a second pivot-mounting section comprising a second pin 20 with a pivot axis Y. As can be seen from FIG. 1, the pivot axes are offset or eccentric with respect to one another.

The first pivot pin 16 is adapted to be received within hole 51 in member 50 so that member 50 can pivot thereabout. The second pivot pin 20 is received within a hole 53 in the second member 52 so that, under selected conditions, it can rotate within that hole.

The pivot-mounting element further includes an engager section 24 in the form of a flange or collar 25. As shown, the flange 25 is in the form of a hexagonal shaped collar with a plurality of sides, three of which are identified by the reference numerals 26, 27, and 28, the flange or collar 25 being disposed between the pivot pins 16 and 20.

Figure 2:
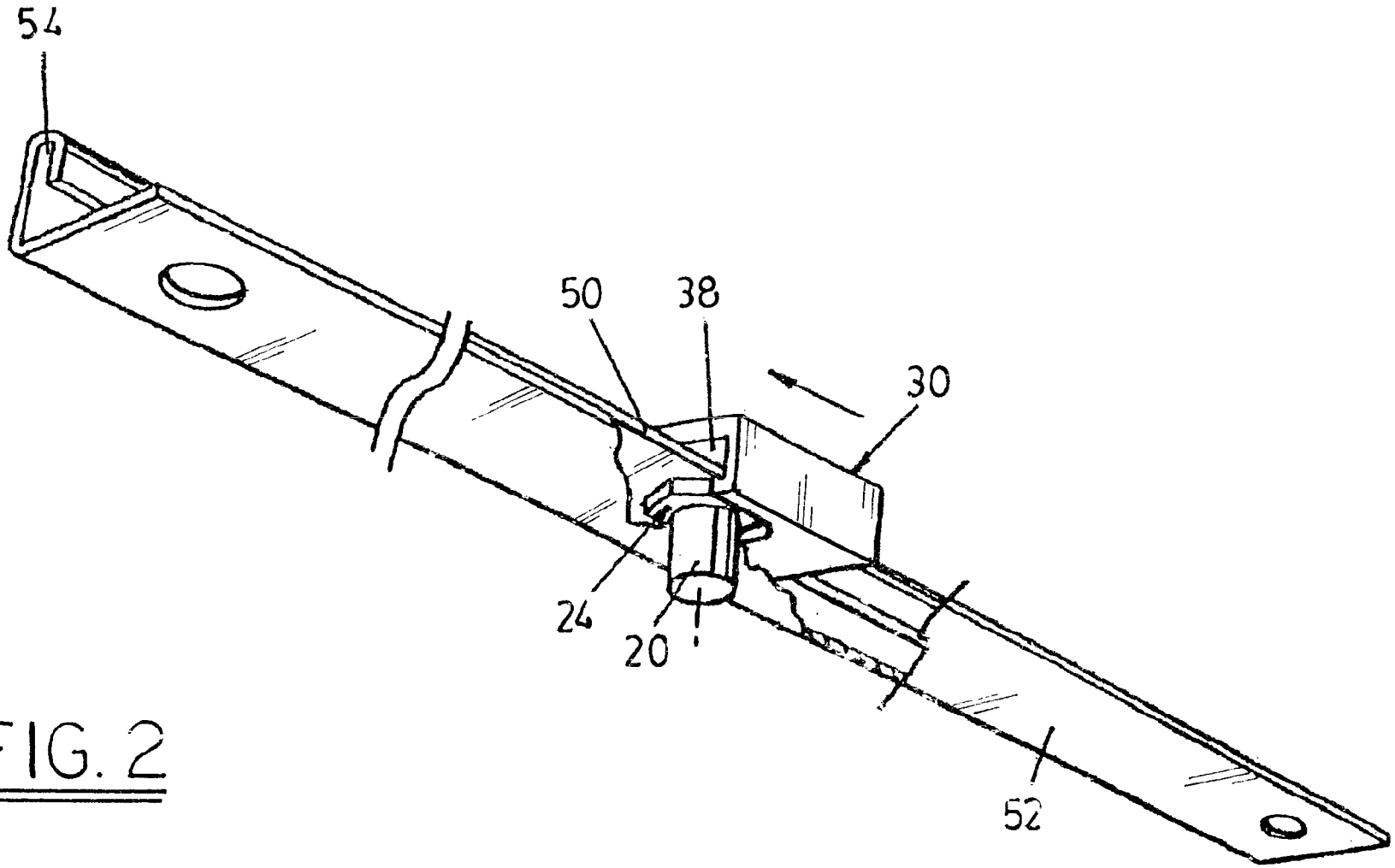
FIG. 2 is a similar view to that shown in FIG. 1 of the adjustment assembly, shown in the locked position.
Figure 3:
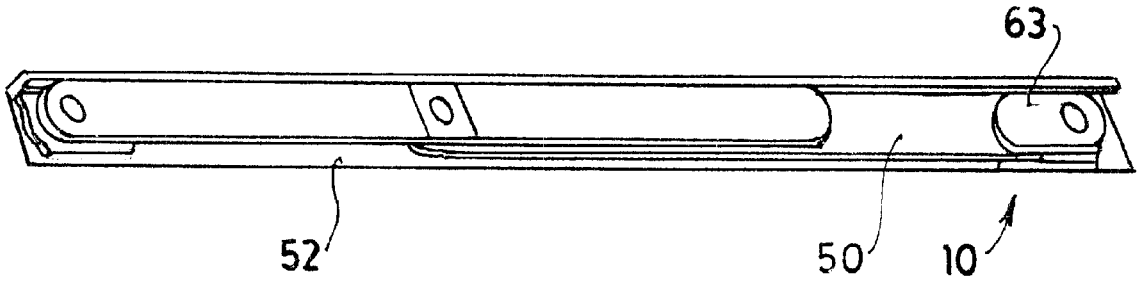
FIG. 3 is a schematic perspective view of a second embodiment of an adjustment assembly according to the present invention, shown in a locked position.
Figure 4:
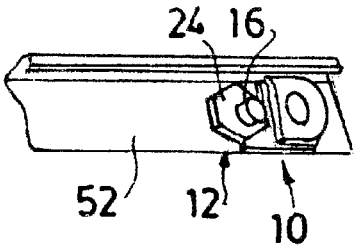
FIG. 4 provides a cut-away perspective view of the second embodiment of an adjustment assembly in a locked position.

In the first preferred embodiment illustrated in FIGS. 1 and 2, the assembly further includes a locking member 30 which is movable relative to the pivot-mounting element 12 between a release position as shown in FIG. 1 and an engaged or locked position as shown in FIG. 2. The locking member 30 includes a body portion 31 having a guide 32 thereon. Guide 32 is locatable within a slot 54 on the member 52 which defines a track enabling sliding movement of the body therealong.

The body further includes a recess 35 having side walls 36 and 37 which are adapted to cooperate with the engager section 24 to limit rotation of the second pin when in the locked position. The recess 35 has a cavity 38 thereabove, the cavity 38 including an upper wall 39 which in the locked position overlies pin 16 to hold the first member 50 in place thereon.

The operation of the assembly 10 shown in the drawing figures for both preferred embodiments will hereinafter be described with reference to its particular use in connection with hinge mechanisms for window assemblies. Referring to the drawings, the member 52 is in the form of a runner frame of a hinge mechanism, this runner frame being mounted to a window frame, and member 50 is in the form of a hinge link, which is operatively connected to the window. The pivot-mounting element 12 operatively interconnects the runner frame 52 and hinge arm 50. The second pivot pin 20 is received within a hole 53 in the runner frame 52. Second pivot pin 20 is adapted to be rotated within the hole 53 when the locking member is in the release position. The engager section 24 is adapted to rest on the upper surface of the runner frame. The hinge arm 50 is adapted to be received on first pivot pin 16 via hole 51 and is able to freely pivot about first pivot pin 16.

In the first preferred embodiment illustrated in FIGS. 1 and 2, the locking member 30 is mounted to the runner frame 52 via guide 32. Slot 54 on runner frame 52 forms a track for guide 32, enabling sliding movement of the locking member 30 along runner frame 52.

When the locking member 30 of the first embodiment is in the release position (that is, the locking member 30 is spaced from pivot-mounting element 10), the second pivot pin 20 can be rotated relative to the runner frame 52. Rotation of the second pivot pin 20 causes displacement of the first pivot pin member 16 relatively to the runner frame and thereby displaces the pivot axis X of member 50 relative to the runner frame. When the pivot axis X of first pivot pin 16 is in the desired position, the locking member 30 is moved into the retention position in which it is located with the sides of recess 35 contacting respective selected sides of the engager member. When this is done, first pivot pin 16 is disposed within recess 38 and member 50 is prevented from lifting off first pivot pin 16 as a result of top wall 39.

In this position, second pivot pin 20 is locked with respect to runner frame 52. Member 50 can pivot on first pivot pin 16. The opening to recess 38 is sufficiently wide to enable the desired pivoting movement of member 50 relative to the runner frame 52. The locking member 30 can be removed from the frame 52 and can serve as a tool for rotating second pivot pin 20.

Figure 5:
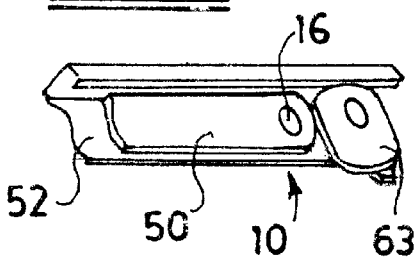
FIG. 5 provides a schematic perspective view of the second embodiment of an adjustment assembly in an unlocked position.
Figure 6:
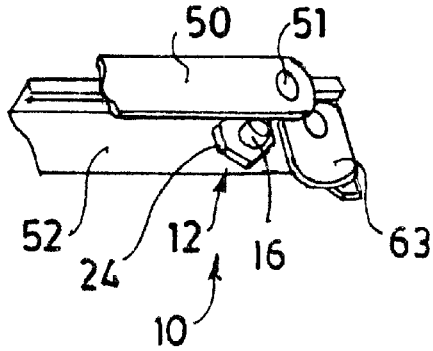
FIG. 6 provides a partially exploded schematic perspective view of the second embodiment of an adjustment assembly in an unlocked position.
Figure 7:
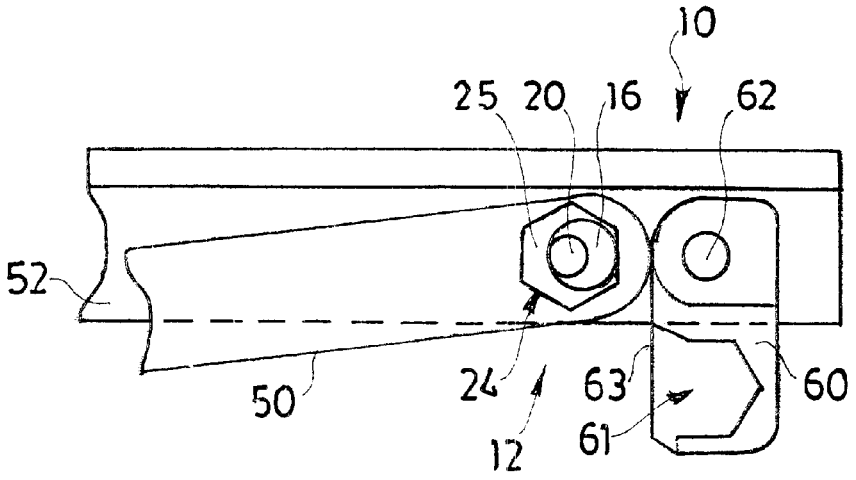
FIG. 7 provides a schematic cross-sectional view illustrating the second embodiment in an unlocked position.
Figure 8:
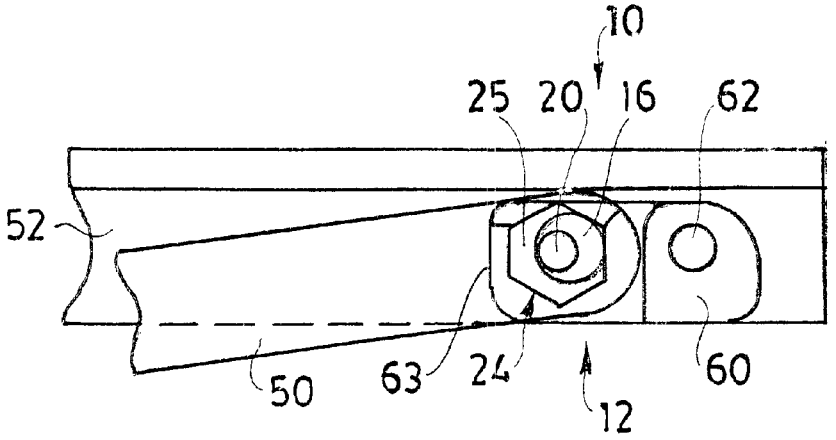
FIG. 8 provides a schematic cross-sectional view illustrating the second embodiment in locked position.
Figure 9:
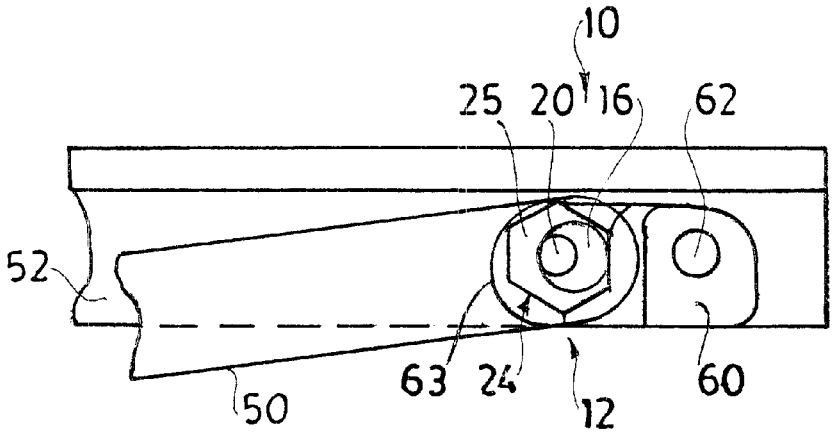
FIG. 9 provides a schematic cross-sectional view illustrating a variation of the second embodiment in a locked position.
Figure 10:
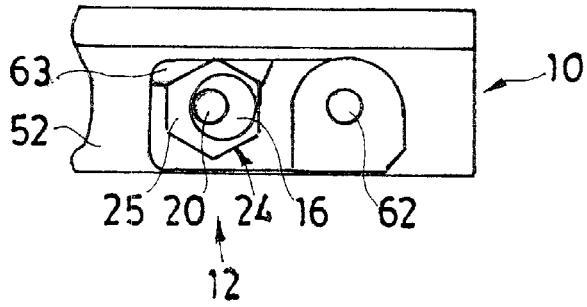
FIG. 10 provides a schematic cross-sectional view illustrating the second embodiment with its second pivot pin in a first position.
Figure 11:
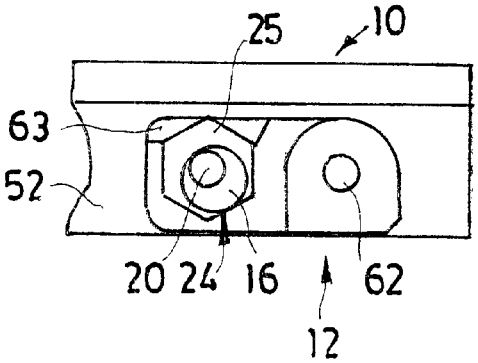
FIG. 11 provides a schematic cross-sectional view illustrating the second embodiment with its second pivot pin in a second position.
Figure 12:
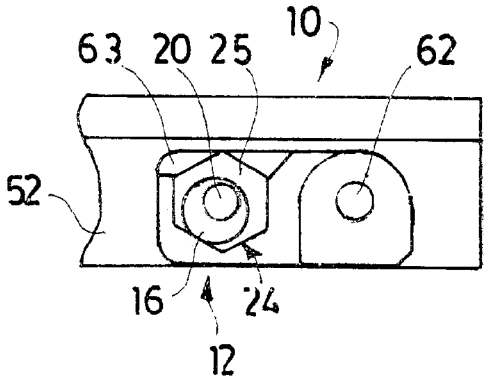
FIG. 12 provides a schematic cross-sectional view illustrating the second embodiment with its second pivot pin in a third position.
Figure 13:
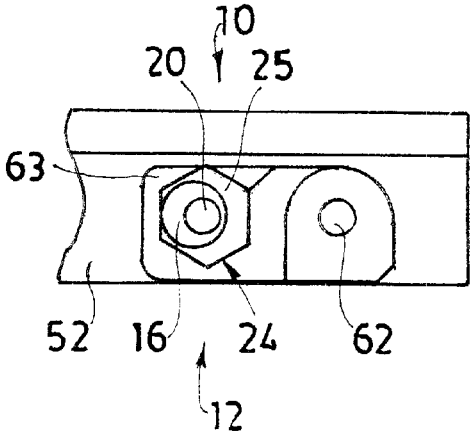
FIG. 13 provides a schematic cross-sectional view illustrating the second embodiment with its second pivot pin in a fourth position.

In the second embodiment illustrated in FIGS. 3 through 13, a pivoting locking member 60 can be rotated into and out of locked position. In its locked position (as illustrated in FIGS. 3, 4, and 8 through 13), pivoting locking member 60 has edges (denoted generally by arrow 61 in FIG. 7) that are adapted to cooperate with engager section 24 to limit rotation of the second pivot pin 20. The pivoting locking member 60 can be provided with means for affixing it firmly in locked position, such as a screw 62 that can serve as its pivot and can also be tightened to secure it in the locked position. Screw 62 can also be loosened to allow the pivoting locking member 60 to be rotated into an unlocked position (as illustrated in FIGS. 5 through 7). The pivoting locking member 60 is also provided with an upper member 63, which in the locked position overlies the first pivot pin 16 and serves to hold member 50 in place on first pivot pin 16 adjacent runner frame 52. Two variations of pivoting locking member 60 are illustrated. The first variation, as illustrated in FIGS. 3 through 6 and 9, only interfaces with two edges of engager section 24. The second variation, as illustrated in FIGS. 7, 8, and 10 through 13, interfaces with four edges of engager section 24 and provides a more positive grip to prevent rotation thereof.

Finally, it is to be understood that the inventive concept in any of its aspects can be incorporated in many different constructions so that the generality of the preceding description and the claims that follow is not to be superseded by the particularity of the attached drawings. Various alterations, modifications, and/or additions can be incorporated into the various constructions and arrangements of parts without departing from the spirit or ambit of the invention.

We claim:

1. An adjustment assembly for enabling lateral adjustment of the position of a pivot connection of a first member relative to a second member, comprising:

a rotatable pivot-mounting element, which pivot-mounting element includes a first pivot-mounting section having a first pivot axis, a second pivot-mounting section having a second pivot axis that is generally parallel to and offset from the first pivot axis, and an engager section; and a locking member adapted to cooperate with the engager section, the locking member being movable relative to the engager section between a retention position and a release position, the locking member preventing rotation of the pivot-mounting element when it is in the retention position and allowing rotation of the pivot-mounting element when it is in the release position.

2. An adjustment assembly, as described in claim 1, wherein the first member is not inhibited from rotation relative to the first pivot-mounting section when the locking member is in a retention position.

3. An adjustment assembly, as described in claim 1, wherein the engager section is located between the first pivot-mounting section and the second pivot-mounting section.

4. An adjustment assembly, as described in claim 1, wherein the engager section has angled edges which are engaged by the locking member when the locking member is in a retention position.

5. An adjustment assembly, as described in claim 1, wherein the locking member is slideably mounted to the second member.

6. An adjustment assembly, as described in claim 1, wherein the locking member is slideably mounted to the second member.

7. An adjustment assembly, as described in claim 1, wherein the locking member is pivotally mounted to the second member.

8. An adjustment assembly, as described in claim 7, wherein the locking member is rotated around its pivot on the second member into a retention position engaging the engager section.

9. An adjustment assembly, as described in claim 1, wherein the locking member has an upper wall that retains the first member on the first pivot-mounting section when the locking member is in a retention position.

10. An adjustment assembly for enabling lateral adjustment of the position of a pivot connection of a first member relative to a second member, comprising:

a first member;

a second member;

a rotatable pivot-mounting element, which pivot-mounting element includes a first pivot-mounting section operatively connected to the first member, which first pivot-mounting section has a first pivot axis, a second pivot-mounting section operatively connected to the second member, which second pivot-mounting section has a second pivot axis that is generally parallel to and offset from the first pivot axis, and an engager section; and a locking member adapted to cooperate with the engager section, the locking member being movable relative to the engager section between a retention position and a release position, the locking member preventing rotation of the pivot-mounting element when it is in the retention position and allowing rotation of the pivot-mounting element when it is in the release position.

11. An adjustment assembly, as described in claim 10, wherein the first member is not inhibited from rotation relative to the first pivot-mounting section when the locking member is in a retention position.

12. An adjustment assembly, as described in claim 10, wherein the engager section is located between the first pivot-mounting section and the second pivot-mounting section.

13. An adjustment assembly, as described in claim 10, wherein the engager section has angled edges which are engaged by the locking member when the locking member is in a retention position.

14. An adjustment assembly, as described in claim 10, wherein the locking member is pivotally mounted to the second member.

15. An adjustment assembly, as described in claim 14, wherein the locking member is rotated around its pivot on the second member into a retention position engaging the engager section.

16. An adjustment assembly, as described in claim 10, wherein the locking member has an upper wall that retains the first member on the first pivot-mounting section when the locking member is in a retention position.

* * * * *